US005569360A

United States Patent [19]

Huovila et al.

[11] Patent Number: 5,569,360

[45] Date of Patent: Oct. 29, 1996

[54] MULTI-LAYER HEADBOX

[75] Inventors: Jyrki Huovila, Muurame; Petri Nyberg; Michael Odell, both of Jyvaskyla, all of Finland

[73] Assignee: Valmet Corporation, Helsinki, Finland

[21] Appl. No.: 328,021

[22] Filed: Oct. 24, 1994

[30] Foreign Application Priority Data

Oct. 29, 1993 [FI] Finland ..... 93794

[51] Int. Cl.[6] ..... D21F 1/02

[52] U.S. Cl. ..... 162/343; 162/344; 162/336

[58] Field of Search ..... 162/344, 343, 162/336, 216

[56] References Cited

U.S. PATENT DOCUMENTS

| | | | |
|---|---|---|---|
| 3,607,625 | 9/1971 | Hill et al. | 162/343 |
| 3,853,697 | 12/1974 | Parker et al. | 162/343 |
| 4,181,568 | 1/1980 | Pfaler | 162/343 |
| 4,543,162 | 9/1985 | Hildebrand | 162/343 |
| 4,617,091 | 10/1986 | Rodal et al. | 162/343 |
| 5,110,416 | 5/1992 | Linsuri et al. | 162/343 |

FOREIGN PATENT DOCUMENTS

| | | |
|---|---|---|
| 51229 | 7/1969 | Finland . |
| 84193 | 7/1991 | Finland . |
| 1443540 | 7/1976 | United Kingdom . |

*Primary Examiner*—Donald E. Czaja
*Assistant Examiner*—Calvin Padgett
*Attorney, Agent, or Firm*—Steinberg, Raskin & Davidson, P.C.

[57] ABSTRACT

A multi-layer headbox including at least two inlet headers for stock through which separate stocks are passed into a system of distributor pipes and further through a turbulence generator into a slice cone narrowing in the stock flow direction. Flaps are placed in the slice cone and one end of the flaps is attached to the turbulence generator. The flaps have at least two flap faces between which a step is formed. The step is arranged on the flap in an area in which the flap, and the flow duct, is curved and its the function is to dissipate any secondary vortices that might form on the curved flap face.

17 Claims, 4 Drawing Sheets

MULTI-LAYER HEADBOX

BACKGROUND OF THE INVENTION

The present invention relates to a multi-layer headbox comprising a narrowing slice cone and separation lamellae extending from flaps out of the discharge opening of the slice cone.

In the operation of prior art multi-layer headboxes, so-called impurity of layers has been noticed, i.e., different layers tend to be mixed together or to be distributed unevenly. This phenomenon has been noticed in particular in multi-layer headboxes in which there is an intensively narrowing slice cone. In this type of headbox, the outer stock layers change their direction when they come out of the narrowing slice cone through the discharge opening to form parallel discharge jets. This change in direction produces so-called secondary vortices, which further produce vanes, i.e. the impurity of layers and uneven distribution of layers mentioned above. For example, the middle layer tends to be mixed with the surface layer. These secondary vortices are produced by the change in the flow direction on the curved face of the flap.

OBJECTS AND SUMMARY OF THE INVENTION

It is an object of the present invention to provide a new and improved headbox in which the presence of secondary vortices in the vicinity of the slice cone is substantially eliminated.

To achieve this object and others, secondary vortices are eliminated by forming a step in connection with the flap at which any secondary vortices that might form are dissipated or disintegrated. In proximity to the curved flow duct defined by the flap and the slice-cone wall, at the side of its outer radius, a step is formed on the flap. In order that the flow could be restored to laminar form and in order that the flows in the different layers could be made parallel to one another, the end of the slice cone of the multi-layer headbox is constructed so that, at the end of the flap that comprises a step, there is additionally an articulated separation lamella. Further, in connection with the discharge opening (in the stock flow direction), after the opening, a wall is provided which is parallel to the longitudinal axis (x-axis) of the slice cone and whose length is proportional to the height of the step. If the height of the step is S, the length L of the wall is from about 8 to about 10 times S. By means of this arrangement at the trailing side of the slice cone, the stock flows in the different layers of the multi-layer headbox are caused to flow parallel to one another and the flow disturbance produced by the step is attenuated. This flow disturbance eliminates the secondary vortices arising on the flap face in its laminar-flow layer.

In the multi-layer headbox in accordance with the invention, flaps are arranged in the slice cone and comprise at least two flap faces having a step arranged therebetween. The step is arranged at the flap in the area in which the flap is curved, i.e., in a region of the flow duct in which the flow changes direction. The function of the step is to dissipate or disintegrate any secondary vortices that might form on the curved flap face. The curved flap face is defined by a change in the principal direction of the flap necessitated by the narrowing of the slice cone.

The invention will be described in the following with reference to some preferred embodiments of the invention shown in the figures in the accompanying drawings. However, the invention is not confined to these embodiments alone.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
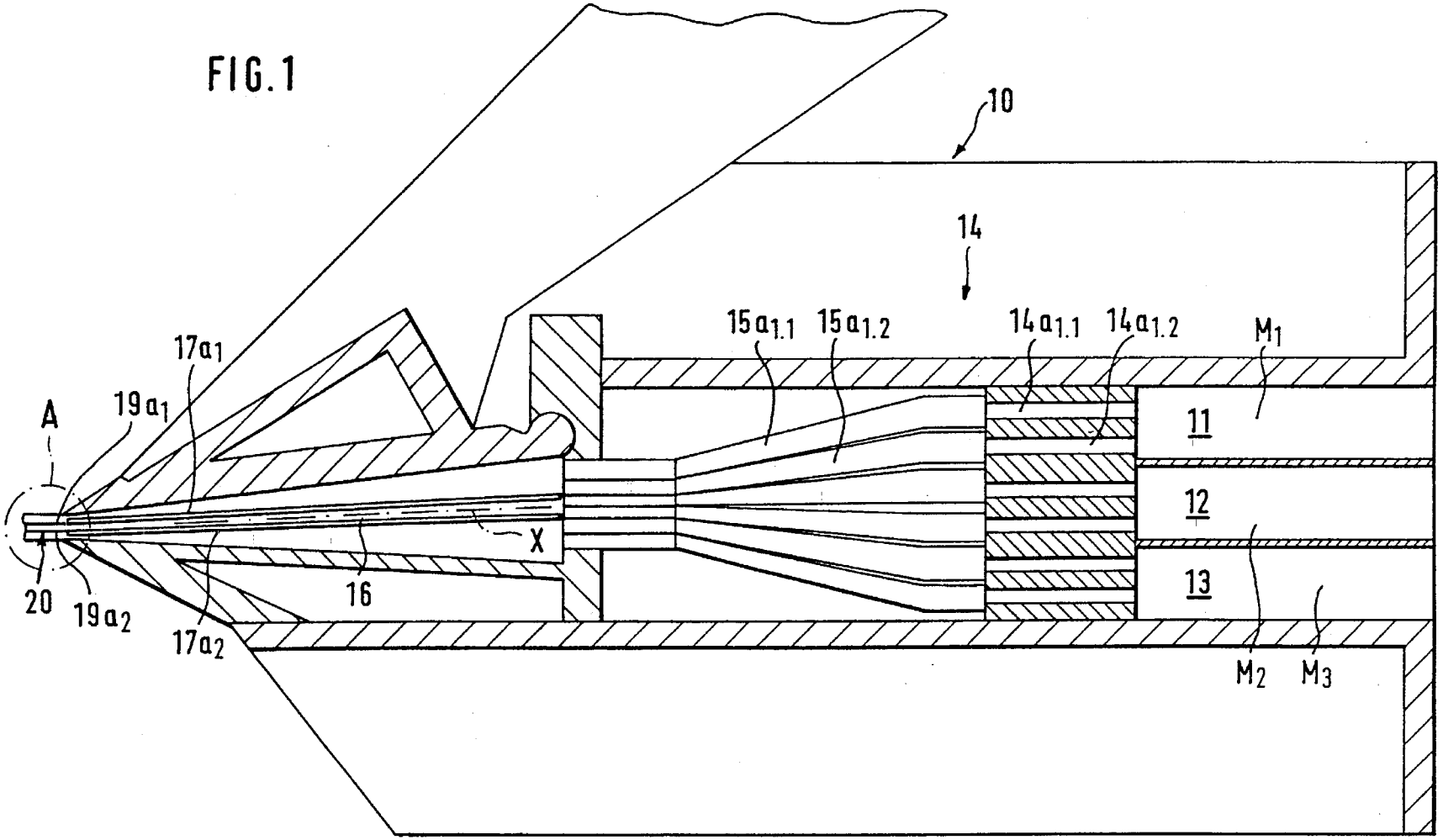
FIG. 1 is a sectional view of a multi-layer headbox in accordance with the invention which comprises a narrowing slice cone and is used in the method in accordance with the invention.

Referring to the accompanying drawings wherein like reference numerals refer to the same elements, FIG. 1 is a sectional view of a multi-layer headbox 10 in accordance with the invention for a paper machine. By means of headbox 10, three web layers are formed: a first web layer produced out of stock $M_1$ from inlet header 11, a second web layer produced out of stock $M_2$ from inlet header 12, and a third web layer produced out of the stock $M_3$ from the inlet header 13. From the header 11, the stock $M_1$ flows through distributor pipes $\mathbf{14}a_{1.1}$, $\mathbf{14}a_{1.2}$, . . . , from the header 12, the stock $M_2$ is made to flow through distributor pipes $\mathbf{14}a_{2.1}$, $\mathbf{14}a_{0.2}$, . . . , and from the header 13, the stock $M_3$ is made to flow through additional distributor pipes $\mathbf{14}a_{3.1}$, $\mathbf{14}a_{3.2}$, . . . From the distributor pipes, the flows enter into a turbulence generator 15 and specifically into respective turbulence tubes $\mathbf{15}a_{1.1}$, $\mathbf{15}a_{1.2}$, . . . , $\mathbf{15}a_{2.1}$, $\mathbf{15}a_{2.2}$, . . . arranged therein. From the turbulence generator 15, the stocks $M_1$, $M_2$ and $M_3$ flow further into a slice cone 16. The sectional form of the slice cone 16 is intensively conical and becomes narrower towards a discharge opening C. Flaps $\mathbf{17}a_1$,$\mathbf{17}a_2$ are arranged in the slice cone 16 and one end of the flaps is connected to the turbulence generator 15.

Figure 2:
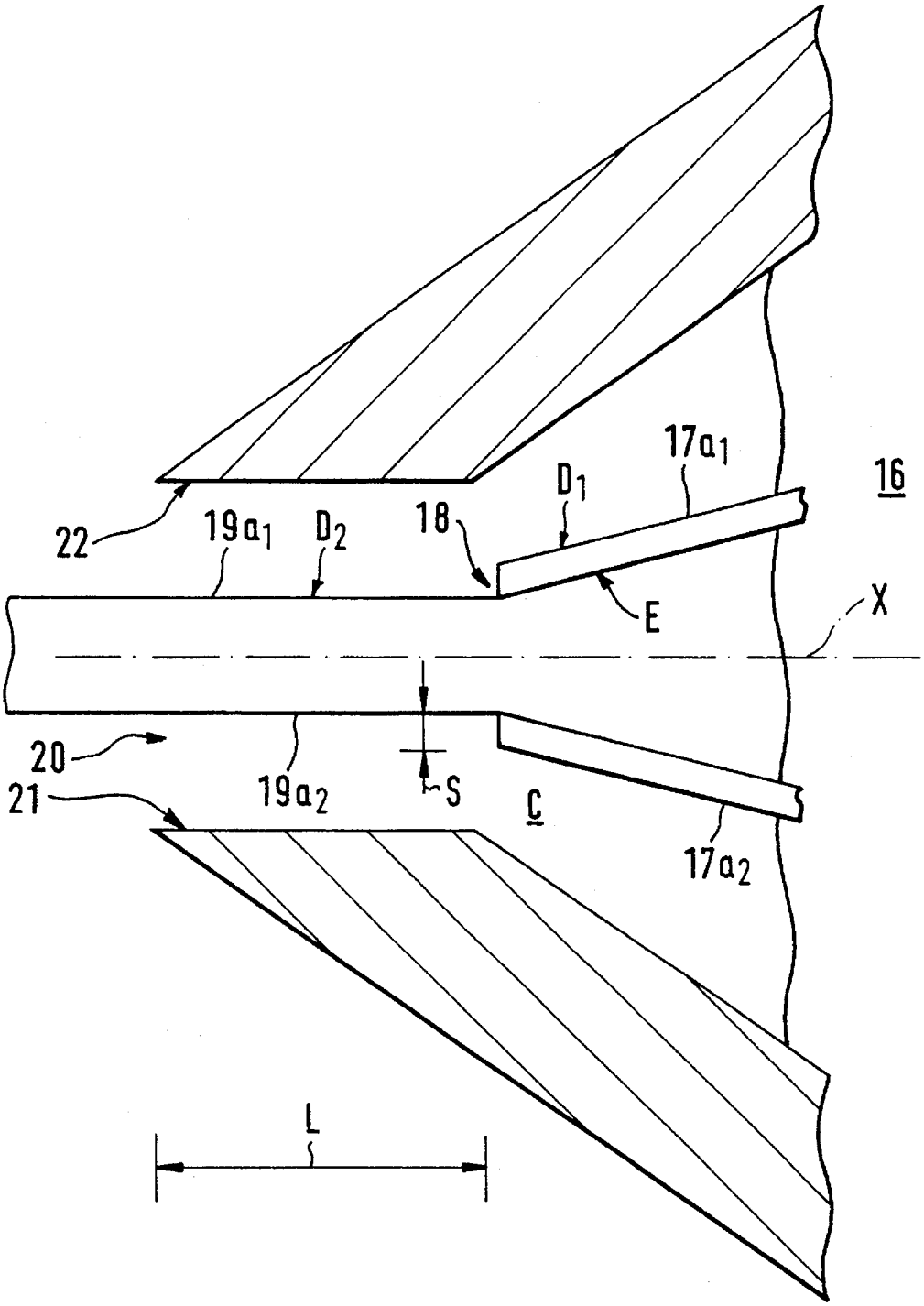
FIG. 2 is an enlarged view of the area A in FIG. 1.

FIG. 2 is an enlarged view of the area A in FIG. 1. The flows of the stocks $M_1$ and $M_3$ pass along intensively curved flap faces $D_1$ on an inner side, which substantially conform to the inner surface of the narrowing slice cone, in which connection so-called Taylor-Goertler vortices are often formed. These vortices produce impurity of layers and mixing together of layers. With a view toward preventing the formation or generation of such vortices, the flap face $D_1$ is connected with a second face $D_2$ arranged at a different height level. A step 18 is formed between face $D_1$ and face $D_2$. The function of the step 18 is to dissipate and disintegrate any secondary vortices that might have been formed. The length L of the straight duct portion 20, which constitutes an extension for the discharge duct or slice cone 16, is about 8 to about 10 times the height S of the step 18. The step 18 is preferably continuous in a direction transverse to the stock flow direction.

As shown in FIG. 2, the flaps $\mathbf{17}a_1$ and $\mathbf{17}a_2$ comprise separation lamellae $\mathbf{19}a_1$,$\mathbf{19}a_2$ at their ends which provide face $D_2$ which is at an angle to face E thereby providing a curvature, i.e., change in direction. By the effect of the flow, the separation lamellae $19a_1$,$19a_2$ are positioned substantially parallel to the longitudinal axis X of the discharge duct 16. Since the thickness of a lamella $19a_1$,$19a_2$ is considerably smaller than that of a main body portion a flap $17a_1$, $17a_2$, by means of this difference, step 18 is thus formed at the junction between the separation lamella $19a_1$,$19a_2$ and the respective main body portion of flap $17a_1$,$17a_3$ associated therewith in proximity to the location at which the principal direction of the flap changes direction. Preferably, the separation lamella comprise a substantially planar plate which provides a continuous step 18 extending in a direction transverse to the stock flow direction.

The lamellae $19a_1$,$19a_2$ are connected to the main body portion of the faces E of the flaps $17a_1$,$17a_3$ placed at the side of the central axis (x-axis) of the slice cone so that the step 18 is formed at one side of the flap/separation-lamella construction only, i.e. at the side at which the flow path between the flap and the wall of the slice cone is curved intensively. In the embodiment shown in FIGS. 1 and 2, there is an adhesive joint between the flaps and the separation lamellae provided by suitable adhesion means, e.g., glue.

An extension of the discharge opening C consists of a straight duct portion 20, which comprises outer walls 21 and 22 arranged substantially parallel to the longitudinal axis (x-axis) of the slice cone 16. The length of these walls 20,21 is about 8 to about 10 times the height S of the step 18.

Figure 3A:
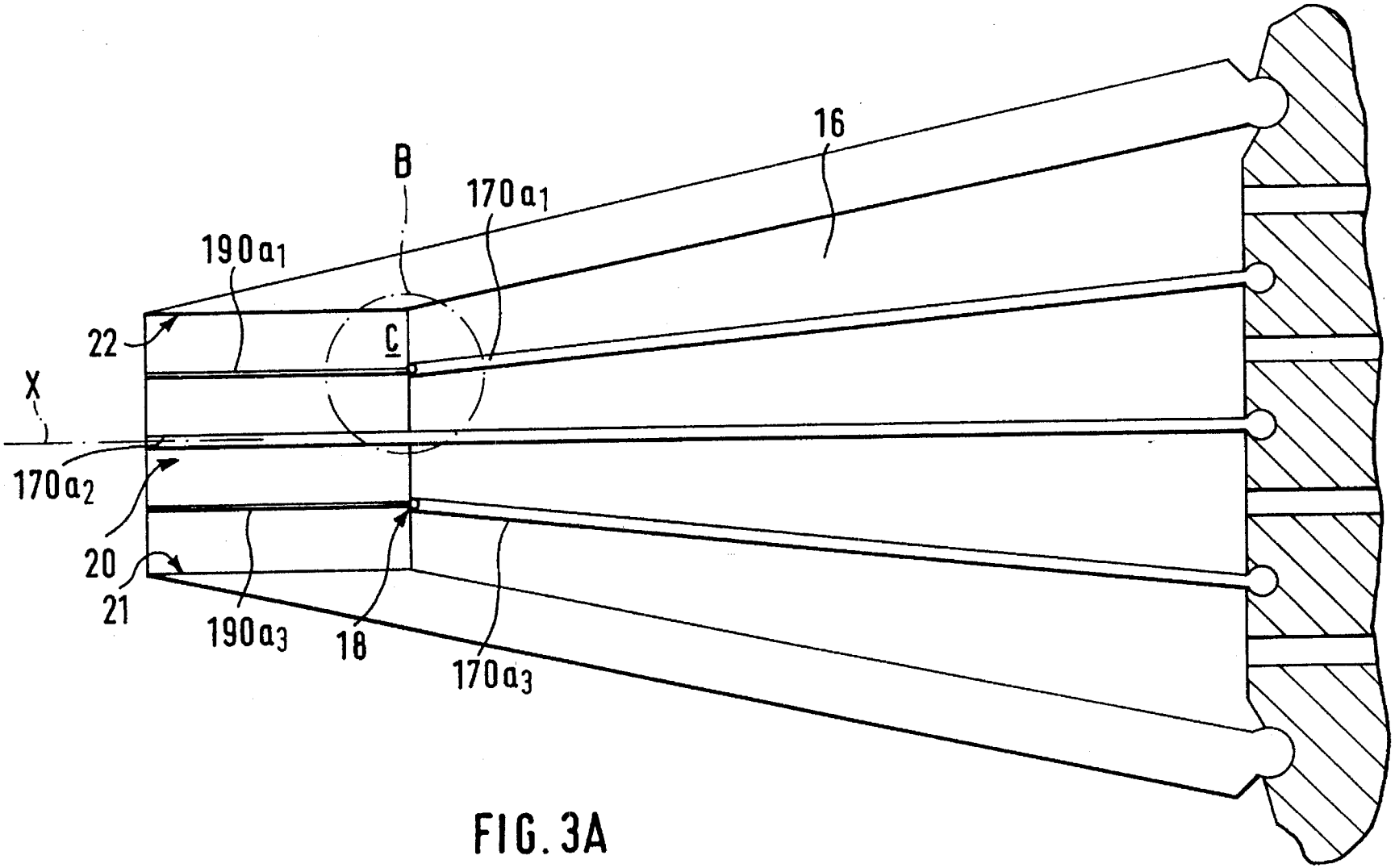
FIG. 3A shows a second embodiment of the flap/separation-lamella construction in accordance with the invention.

FIG. 3A shows an embodiment of the invention in which the slice cone 16 comprises flaps $170a_1$ and $170a_3$, to whose ends separation lamellae $190a_1$,$190a_3$ are linked by means of articulated joints. On the central axis X of the slice cone, a flap $170a_2$ is arranged, which extends from the discharge opening C out into the duct 20. The duct 20 comprises walls 21 and 22 positioned in a position substantially parallel to the longitudinal axis (X-axis) of the slice cone 16. In this embodiment, vortices may form at both sides of the flaps $170a_1$, $170a_3$ and therefore the separation lamellae $190a_1$, $190a_3$ are preferably positioned to provide a step on both sides of the respective flaps $170a_1$, $170_3$ as shown.

Figure 3B:
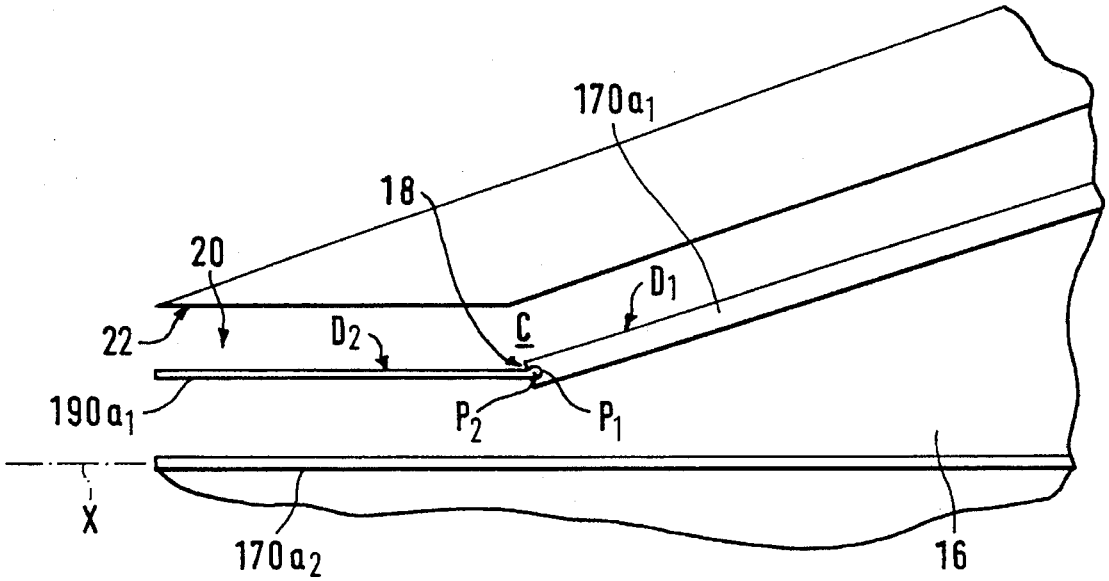
FIG. 3B is an enlarged view of the area B in FIG. 3A.

FIG. 3B is an enlarged view of the construction of separation-lamella/flap $170a_1$,$190a_1$. The flap $170a_1$ comprises an end opening $P_1$ having a circular shape, into which an articulated end $P_2$ of the separation lamella $190a_1$ having a corresponding sectional shape is arranged. The articulation point thus formed guarantees that the flow can position the separation lamella in a position parallel to the longitudinal axis X of the slice cone, which corresponds to the axis of the straight portion of duct 20. Step 18 is thus formed between the separation lamella and the flap in the discharge opening C at the beginning of the straight portion of duct 20. The function of the middle flap $170a_2$, which extends out from the discharge opening C, is to operate as an equalizer of the turbulence which is produced by the articulation point $P_1/P_2$ and which disturbs the flow. All of the flaps $170a_1$,$170a_2$, $17a_3$ are linked by means of articulated joints at their ends next to the turbulence generator.

The examples provided above are not meant to be exclusive. Many other variations of the present invention would be obvious to those skilled in the art, and are contemplated to be within the scope of the appended claims.

We claim:

1. Multi-layer headbox including inlet headers for stock from which at least two separate stocks flow into a system of distributor pipes and then through a turbulence generator into an elongate slice cone having a narrowing portion in a stock flow direction, comprising a straight duct portion arranged after said narrowing portion in the stock flow direction, and at least one elongate flap arranged at least partially in said slice cone separating two of the stock flows and defining in part a pair of flow ducts, at least one of said flow ducts having a first region in said narrowing portion of said slice cone in which the stock flows in a first direction and a second region following said first region in said straight duct portion in which the stock flows in a second direction different than said first direction such that the stock flow direction curves, one end of said at least one flap being attached to the turbulence generator, said at least one flap comprising a main body portion having a first thickness arranged in said narrowing portion of said slice cone and a flap extension having a second thickness less than the first thickness, said flap extension being arranged in said straight duct portion and being connected to said main body portion such that a step is defined between said main body portion and said flap extension in a region of intersection of said straight duct portion and said narrowing portion of said slice cone in which the stock flow changes direction from said first direction to said second direction, said step being arranged to dissipate secondary vortices forming on faces of said at least one flap.

2. The multi-layer headbox of claim 1, wherein said straight duct portion is defined by duct walls, said duct walls being arranged substantially parallel to a longitudinal axis of said slice cone.

3. The multi-layer headbox of claim 2, wherein the length of said duct walls is about 8 to about 10 times the height of said step.

4. The multi-layer headbox of claim 1, wherein said separation lamella is positioned flush with an inner face of said at least one flap.

5. The multi-layer headbox of claim 1, further comprising means for attaching said separation lamella to an inner face of said at least one flap.

6. The multi-layer headbox of claim 5, wherein said means comprise an articulated joint formed between said separation lamella and said at least one flap.

7. The multi-layer headbox of claim 6, wherein said at least one flap has an opening at an end thereof opposed to the end attached to the turbulence generator, said separation lamella engaging with said opening to form said articulated joint.

8. The multi-layer headbox of claim 1, wherein said separation lamella comprise a planar plate.

9. The multi-layer headbox of claim 1, wherein said at least one flap comprises two of said flaps and a middle, substantially planar flap arranged between said two flaps, said middle flap extending into a discharge opening of said slice cone.

10. The multi-layer headbox of claim 9, wherein said separation lamella extend substantially parallel to and coextensive with said middle flap.

11. The multi-layer headbox of claim 1, wherein said step is continuous in a direction transverse to the stock flow direction.

12. The multi-layer headbox of claim 1, wherein the slice cone is defined by walls, said at least one flap being arranged in said slice cone apart from said walls.

13. The multi-layer headbox of claim 1, wherein the inlet headers comprise three inlet headers from which flows a separate stock into the system of distributor pipes and then through the turbulence generator into the slice cone, said at least one flaps comprising two flaps, each of said two flaps being arranged between an adjacent pair of the stock flows.

14. The multi-layer headbox of claim 1, wherein said step is arranged at an intermediate location between longitudinal ends of said at least one flap.

15. The multi-layer headbox of claim 1, wherein said main body portion has a first flap face and said flap extension has a second flap face, said step being defined between said first and second flap faces.

16. The multi-layer headbox of claim 1, wherein said straight duct portion is integrally connected to said narrowing portion of said slice cone.

17. The multi-layer headbox of claim 2, wherein said second region is defined by one of said walls and said flap extension.

* * * * *